United States Patent [19]

Cho

[11] Patent Number: 4,697,286

[45] Date of Patent: Oct. 6, 1987

[54] PROTECTIVE THIGH AND KNEE GEAR

[75] Inventor: Soo S. Cho, Roseland, Fla.

[73] Assignee: Macho Products, Inc., Palm Bay, Fla.

[21] Appl. No.: 874,214

[22] Filed: Jun. 13, 1986

[51] Int. Cl.[4] ..... A41D 13/00

[52] U.S. Cl. ..... 2/22; 2/2; 2/51; 272/76; 272/93

[58] Field of Search ..... 2/2, 22, 23, 24, 62, 2/1, 2.5, 48, 51, 46; 272/76; 273/1 F

[56] References Cited

U.S. PATENT DOCUMENTS

| | | | |
|---|---|---|---|
| 562,608 | 6/1896 | Herbelin | 2/51 X |
| 589,562 | 9/1897 | Gray | 2/62 X |
| 1,580,453 | 4/1926 | Stentiford | 2/46 X |
| 1,586,235 | 5/1926 | Billingsky | 2/62 |
| 1,670,935 | 5/1928 | Maynard | 2/22 |
| 1,772,922 | 8/1930 | Volz | 2/22 |
| 1,772,923 | 8/1930 | Volz | 2/22 |
| 1,991,721 | 2/1935 | Becket et al. | 2/2 |
| 2,266,886 | 12/1941 | McCoy | 2/2 |
| 3,945,041 | 3/1976 | Rhee | 2/2 |
| 4,497,070 | 2/1985 | Cho | 2/22 |

FOREIGN PATENT DOCUMENTS

| | | | |
|---|---|---|---|
| 1191003 | 4/1959 | France | 2/46 |
| 955486 | 4/1964 | United Kingdom | 2/22 |
| 1189434 | 4/1970 | United Kingdom | 2/22 |

*Primary Examiner*—William Price
*Assistant Examiner*—T. Graveline
*Attorney, Agent, or Firm*—Duckworth, Allen & Dyer

[57] ABSTRACT

An improved protective device for the thigh and knee of a participant in martial art activities or the like. The device includes a main body portion formed of a resilient, conformable foam such as a closed cell polyvinyl chloride foam or the like with a pliable coating of polyvinyl chloride or the like. The main body portion has an enlarged main section, an upwardly extending tapering section, a downwardly extending larger lower section and a downwardly extending smaller lower section. The downwardly extending larger lower section and the downwardly extending smaller lower section are separated by a recess with the recess being located closer to one edge than the other. Straps secure the main body portion to the thigh and knee of a wearer.

7 Claims, 4 Drawing Figures

PROTECTIVE THIGH AND KNEE GEAR

BACKGROUND OF THE INVENTION

1. Field of the Invention

The present invention relates to thigh and knee gear for protecting a wearer from the force of a blow while participating in karate or other martial arts activity and, more particularly, to gear with generally rectangular sections designed to protect a wearer from the force of blows to the thighs and with depending sections designed to protect a wearer from the force of blows to the fronts and sides of the knees.

2. Description of the Prior Art

While engaging in martial arts activities such as karate, whether practicing or participating in defensive tactics training, an exhibition, demonstration or the like, a practitioner uses his hands, fists, arms, feet or weapons to inflict blows upon another's head and body including the thigh and knee region. These blows may result in an injury to the receiver of the blow unless the force of the blow is lessened prior to physical contact. Such lessening may be achieved either by the receiver wearing protective gear or by the practitioner delivering less than full blows, i.e., pulling punches. During karate exhibitions, demonstrations, or the like, spectator appeal of the sport would be diminished if the delivery of the blows had to be restricted in order to avoid injury. Additionally, the benefits of practicing defensive tactics such as may be required by police and military personnel and the value of simulation training or the like would be minimized if repeated blows could not be fully delivered by the practitioner to a colleague, coach or another. As can be readily understood, protective gear is the preferred solution. Such gear should not only protect the wearer from injury, it should also allow the wearer to participate in limited martial arts activities while a prior injury is protected and continues to heal. Under certain circumstances, protective gear might also be utilized in martial arts competition, an activity where protective body gear is not normally utilized.

In an attempt to provide effective protection for the participants, particularly for the thigh and knee regions, a number of proposed protective devices have been designed and are available commercially. To achieve the primary objective of safety, any such device must afford superior protection to the wearer while not encumbering the wearer in any appreciable manner. Because of the strenuous activity by the wearer while using any such protective device, it must be light weight and cover only areas requiring protection so as to minimize any weight burden. It must also permit freedom of movement so that the user may effectively participate in the activity as intended.

Typical devices designed in an effort to achieve these objectives are described in the patent literature exemplified by U.S. Pat. Nos. 1,264,916 to Goldsmith; 2,266,886 to McCoy; and 3,269,036 to Parker et al. Each of those prior devices provides some protection to the wearer but at the same time causes some unncessary inconvenience. Some of these prior devices combine protective foam with heavy, rigid material thus causing an added weight burden to the user without an equivalent benefit. Others cover more of the wearer's thigh and knee than necessary which increases cost and body heating. Yet others unnecessarily limit the wearer's freedom of movement.

As illustrated by the large number of prior devices, continuing efforts are being made in an attempt to solve the problem of designing protective, light weight, unencumbering, economical thigh and knee gear. None of the known devices, however, discloses or suggests the present inventive device as disclosed herein. The present invention achieves its purposes, objectives and advantages over the prior approaches through a new, useful and unobvious device, at a reasonable cost, and through the utilization of only readily available materials.

These purposes, objectives and advantages should be construed as merely illustrative of some of the more prominent features and applications of the present invention. Many other beneficial results can be attained by applying the disclosed invention in a different manner or by modifying the invention within the scope of the disclosure. Accordingly, other purposes, objects and advantages as well as a fuller understanding of the invention may be had by referring to the summary of the invention and detailed description describing the preferred embodiment in addition to the scope of the invention as defined by the claims taken in conjunction with the accompanying drawings.

SUMMARY OF THE INVENTION

The present invention is defined by the appended claims with the specific preferred embodiment shown in the attached Figures. For the purposes of summarizing the invention, the invention may be incorporated into an improved device for protecting the thigh and knee of a participant in martial arts activities such as karate or the like. The device includes a main body portion formed of a resilient, conformable foam having a pliable coating. The main body portion has an enlarged main section, an upwardly extending section, a downwardly extending larger lower section and a downwardly extending smaller lower section. The main body portion has an upper and lower edge and an interior and exterior edge. The downwardly extending larger lower section and the downwardly extending smaller lower section are separated by a recess with the recess being located closer to the exterior edge than the interior edge. Straps secure the main body portion to the thigh and knee of a wearer. The straps include first strap means coupled with the upper edge to hold up the main body portion. A pair of second strap means releaseably couples the interior and exterior edges to secure the main body portion around the thigh and knee of the wearer. The foam may be a closed cell polyvinyl chloride foam with a coating of polyvinyl chloride.

In addition, the invention may also be incorporated into improved protective gear for the thighs and knees of the wearer when participating in martial arts activities or the like. The gear includes a pair of foam members, each foam member is formed of a closed cell foam with each foam member having an enlarged generally rectangular main section, an upwardly extending tapering section, a downwardly extending larger lower section and a downwardly extending smaller lower section. Each foam member has an upper edge defined by the upper portion of the tapered section, a lower edge defined by the lower portions of the lower sections, an interior edge defined by one side of the main section and an exterior edge defined by the other side of the main section. A main axis extends through a tapered section, a main section and a larger lower section. The downwardly extending larger lower section and the downwardly extending smaller lower section are separated by a recess. A minor axis extends through the recess parallel with, but offset from, the major axis. A first strap means is attached to each foam member at the upper edge to hold up the main body portion. A second strap means, attached to each foam member releaseably couples the interior and exterior edges to secure each foam member around a thigh and knee of a wearer. The gear further includes a flexible protective coating on the foam. The gear further includes a cut-out in the lower edge adjacent the exterior edge.

BRIEF DESCRIPTION OF THE DRAWINGS

For a more complete understanding of the nature, objects and advantages of the present invention, reference should be had to the following detailed description, taken in conjunction with the accompanying drawings in which.

DETAILED DESCRIPTION OF THE INVENTION

Figure 1:
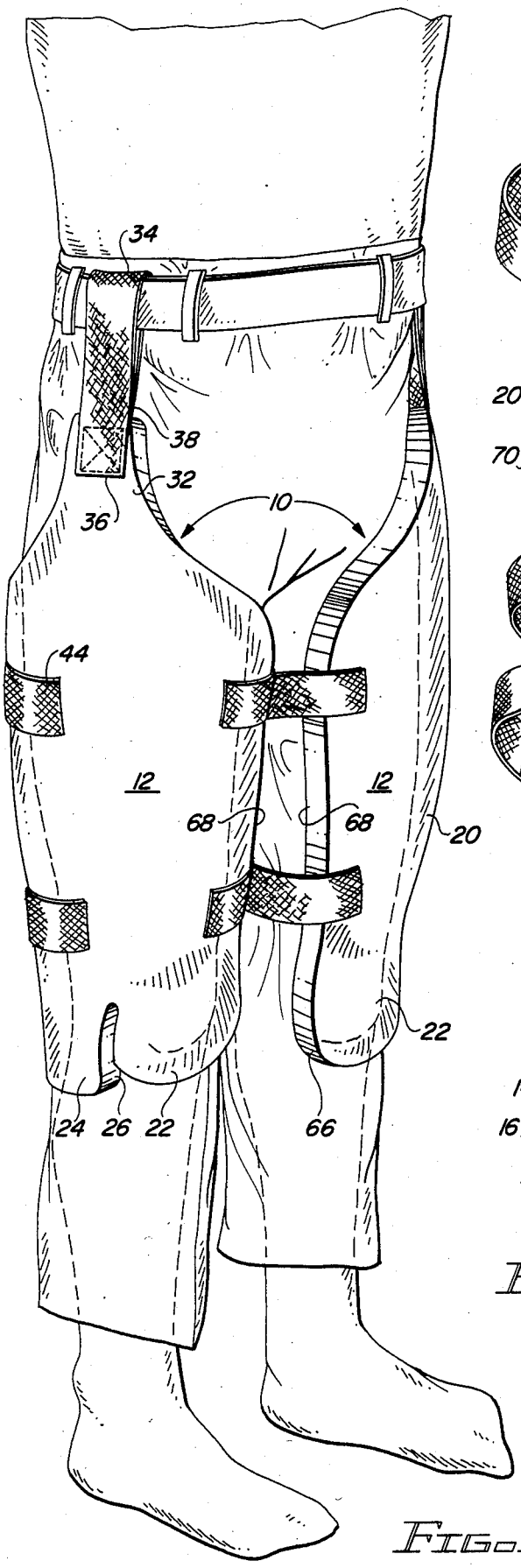
FIG. 1 is a right-front perspective view of thigh and knee gear incorporating the principles of the present invention and illustrating such gear on the legs of a wearer.

The protective thigh and knee gear 10 shown in FIGS. 1 through 4 illustrates the primary embodiment of the present invention. The principal component of the gear or device is a main body portion 12. The main body portion is fabricated of a suitable material 14, comfortable and resilient as well as capable of absorbing energy when contacted and deformed by a blow. Preferred materials include elastomers, such as a closed cell polyvinyl chloride foam or the like. The material is preferably provided with a suitable, pliable surface coating 16 or casing which entirely covers the surface of the foam material. If the material is a polyethylene or polyurethane foam, the coating may not be applied. The coating may be applied to the foam by painting, dipping, or other method of application. A tough, rugged, pliable plastic such as polyvinyl chloride has been found to be a preferred material for the coating. The pieces of the thigh and knee gear are preferably cut to shape while in a flat form. After cutting, the pieces may be shaped to the desired form while the coating is applied and dried. The dried coating retains the foam of the thigh and knee gear in the desired shape curved to conform to the wearer's things and knees. Supplemental straps, indicia or the like may finally be applied.

Figure 2:
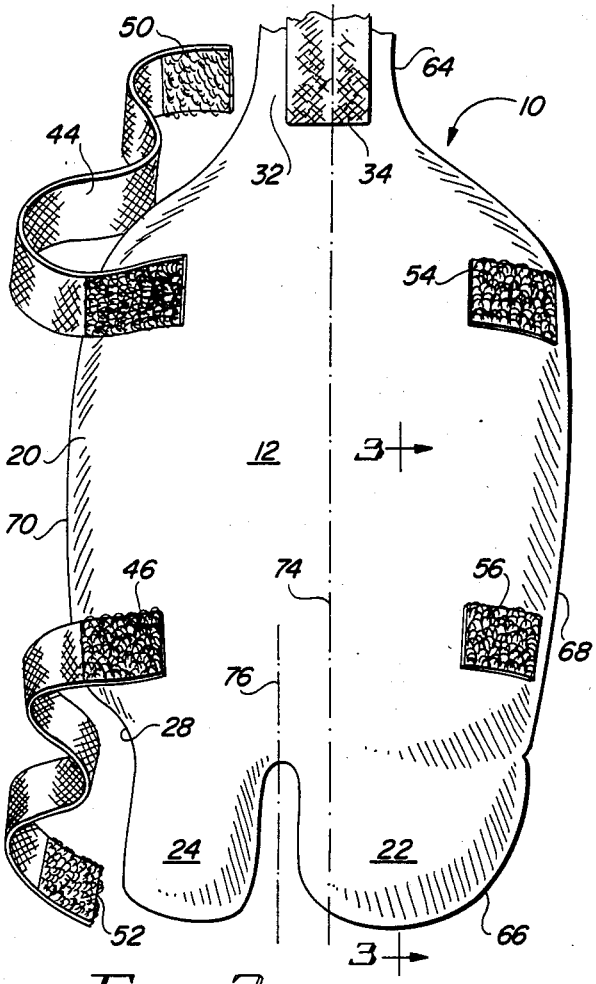
FIG. 2 is a front elevational view of the right thigh and knee gear shown in FIG. 1.
Figure 4:
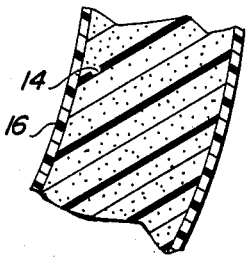
FIG. 4 is an enlarged sectional view of the material of the thigh and knee gear shown in FIG. 3.
Figure 3:
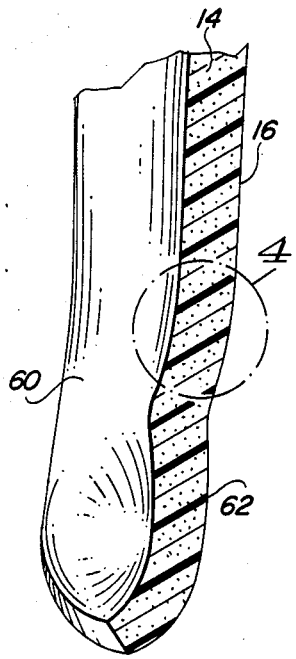
FIG. 3 is a sectional view of a portion of the thigh and knee gear shown in FIGS. 1 and 2 and taken along line 3—3 of FIG. 2.

Each body portion or foam member 12 of the thigh and knee gear includes a generally rectangular central section 20 of coated foam adapted to partially encompass and essentially conform to the front and exterior side of the wearer's thigh. When worn, it extends horizontally from the front interior edge of the upper leg, circumferentially around and overlying the side of the leg. It does not extend between the wearer's legs since blows are not normally received there and protective gear in that area would merely burden a wearer with unnecessary weight and encumber the wearer's movements. Note is taken that a pair of similarly shaped protective devices are shown on a wearer in FIG. 1. One such device, that for the wearer's upper right leg, is shown in FIG. 2. The device for the wearer's upper left leg is essentially the same as that shown and described for the right, the mating devices being only mirror images of each other.

The lower portion of the central or main section 20 is provided with downwardly depending lower sections 22 and 24. The larger lower section 22 protects the front of a wearer's knee. The smaller lower section 24 protects the outside of a wearer's knee. These sections are fabricated of a coated foam, extensions of the main section. An upwardly extending recess 26 separates the larger and smaller sections. Further, a cut-out 28 is formed in the lower exterior corner of the main body portion 12. Together the recess and cut-out allow for flexibility of the device and a greater freedom of movement for a wearer. They also reduce the weight and cost of the device by eliminating material from regions where it is not needed.

Upwardly extending from the central section of each foam member is a tapering upper section 32 whereat an inextensible attachment strap 34 is secured. The upper tapered section extends upwardly from the top of the main section 20. Like the depending lower sections, the upper section is fabricated of a coated foam, an extension of the main section.

Each attachment strap 34, one for each protective device, has its free ends 36 and 38 stitched, glued or otherwise secured to the upper edge of the tapering section. Each strap thus forms a loop through which a belt or other strap may pass in order to hold up the protective devices. The belt may be a regular street belt, a karate belt or some sort of protective device such as pelvic guards worn by boxers.

Securement straps 44 and 46 are also provided for releaseably coupling the protective device to the leg of a wearer. Each protective device preferably includes two such straps, an upper strap 44 and a lower strap 46. The first end of each strap is secured as by gluing, stitching or the like to the exterior face of the protective device adjacent the exterior edge. The second end of each strap is provided with a pile-type fastener 50 and 52 such as that available under the name VELCRO. Pile-type fasteners 54 and 56 are secured to the exterior face of the protective device adjacent the interior edge and are releaseably coupleable with the pile-type fastener of the strap. The securement straps are elastic to allow the protective devices to be used by people with legs of varying sizes.

Each thigh and knee gear or protective device 10 is thus formed of a foam member or main body portion 12 and associated securement and attachment straps 34, 44 and 46. The foam member or main body portion includes the central main section 20, the upper section 32 and the two lower sections 22 and 24. It has an interior face 60 and an exterior face 62, an upper edge 64 defined by the lower portions of the depending sections 22 and 24, an interior edge 68 defined by one side of the main section and an exterior edge 70 defined by the other side of the main section. It has a slight curve about a vertical main axis 74 to conform to the leg of a wearer and extends from beneath the knee to the upper part of the thigh. The configuration is for maximum protection, effectiveness and comfort for the wearer.

The foam member includes a vertically disposed main axis 74 with essentially equal volumes of foam on either side thereof in the central or main section 20. The main axis extends through the tapered section 32, the main section 20 and the larger lower section 22. A minor axis 76 extends along the center of the recess 26 and separates the lower portion into the smaller section 24 for protecting the side of the knee and the larger section 22 for protecting the front of the knee. The minor axis generally separates the exterior side of the protective device which protects the side of the wearer's leg from the interior side of the protective device which protects the front of the wearer's leg. The major and minor axes are offset, one with respect to the other, with the minor axis 76 and recess 26 being nearer the exterior edge 70 than the interior edge 68. This configuration allows for comfortable movement free fitting on the upper leg and knee of a wearer to maximize protection by locating the protective material only on those parts of the body requiring protection.

While the present invention has been described with respect to a particular preferred embodiment, many modifications and variations will become apparent to those skilled in the art. Accordingly, all such variations and modifications are intended to be included within the scope of the appended claims.

What is claimed is:

1. For use by a participant in martial arts activities or the like, an improved protective device for the thigh and knee of the wearer including:

a main body portion formed of a resilient, comformable foam having a pliable coating, the main body portion having an enlarged main section, an upwardly extending section, a downwardly extending larger lower section and a downwardly extending smaller lower section, the main body portion having an upper and lower edge and an interior and exterior edge, the downwardly extending larger lower section and the downwardly extending smaller lower section being separated by a recess with the recess being located closer to the exterior edge than the interior edge and strap means attached to the main body portion to secure the main body portion to the thigh and knee of a wearer.

2. The device as set forth in claim 1 wherein said strap means includes:

first strap means coupled with the upper edge to hold up the main body portion; and a pair of second strap means to releaseably couple the interior and exterior edges to secure the main body portion around the thigh and knee of the wearer.

3. The device as set forth in claim 1 wherein the foam is closed cell polyvinyl chloride foam.

4. The device as set forth in claim 3 wherein the coating is polyvinyl chloride.

5. Improved protective gear for the thighs and knees of the wearer when participating in martial arts activities or the like, including:

a pair of foam members, each foam member formed of a closed cell polyvinyl chloride foam, each foam member having an enlarged generally rectangular main section, an upwardly extending tapering section, a downwardly extending larger lower section and a downwardly extending smaller lower section, each foam member having an upper edge defined by the upper portion of the tapered section, a lower edge defined by the lower portions of the lower sections, an interior edge defined by one side of the main section and an exterior edge defined by the other side of the main section, a main axis extending through the tapered section, the main section and the larger lower section, the downwardly extending larger lower section and the downwardly extending smaller lower section being separated by a recess, a minor axis extending through the recess parallel with, but offset from, the major axis;

first strap means attached to each foam member at the upper edge to hold up the foam member; and second strap means attached to each foam member to releaseably couple the interior and exterior edges to secure each foam member around a thigh and knee of a wearer.

6. The gear as set forth in claim 5 and further including a coating of polyvinyl chloride on the foam.

7. The gear as set forth in claim 5 and further including a cut-out in the lower edge adjacent the exterior edge.

* * * * *